US005535999A

United States Patent [19]

Ford

[11] Patent Number: 5,535,999

[45] Date of Patent: Jul. 16, 1996

[54] APPARATUS FOR ROTATING A FLAT ARTICLE THROUGH A DESIRED ANGULAR ORIENTATION

[75] Inventor: Anthony D. Ford, Junction City, Kans.

[73] Assignee: Axia Incorporated, Oak Brook, Ill.

[21] Appl. No.: 209,843

[22] Filed: Mar. 11, 1994

[51] Int. Cl.[6] ..... B65H 29/00

[52] U.S. Cl. ..... 271/185; 198/377; 271/193

[58] Field of Search ..... 271/184, 185, 271/198; 198/377

[56] References Cited

U.S. PATENT DOCUMENTS

| | | | |
|---|---|---|---|
| 3,303,921 | 2/1967 | Gore et al. | 198/158 |
| 3,317,029 | 5/1967 | Goldammer et al. | 198/158 |
| 3,587,824 | 6/1971 | Rochla | 198/33 |
| 3,608,701 | 9/1971 | Dieter | 198/189 |
| 3,779,546 | 12/1973 | Wojtowicz et al. | 271/196 |
| 3,783,991 | 1/1974 | McCahon et al. | 198/33 |
| 3,847,273 | 11/1974 | Buhayar | 198/377 |
| 4,056,264 | 11/1977 | Dhooge et al. | 271/177 |
| 4,372,436 | 2/1983 | Achelpohl et al. | 198/377 |
| 4,394,898 | 7/1983 | Campbell | 271/185 |
| 4,565,359 | 1/1986 | von Hein | 270/41 |
| 4,648,503 | 3/1987 | Stemmler | 198/410 |
| 4,877,234 | 10/1989 | Mardel | 271/184 |
| 4,890,724 | 1/1990 | Loewenthal | 198/732 |
| 5,012,915 | 5/1991 | Kristola et al. | 271/185 |
| 5,025,910 | 6/1991 | Lasure et al. | 198/377 |
| 5,224,696 | 7/1993 | Kellum | 271/184 |

*Primary Examiner*—H. Grant Skaggs

*Attorney, Agent, or Firm*—Laff, Whitesel, Conte & Saret, Ltd.

[57] ABSTRACT

A device for simultaneously rotating and translating a flat article comprises a flat, low-friction table surface and a plurality of conveyor-driven platens. Each platen frictionally engages an article and transports it linearly along the table surface. Simultaneously, a cam slowly rotates the platen, and with it, the article, through a predefined angular displacement, such as 90 degrees. The conveyer drive is implemented as a spaced pair of continuous chain loops supported by sprockets. The platens include a rotatable platen component supported by a structural carriage. Each carriage is connected to the chains at two positions. The front connection is rotatable about an axis transverse to the direction of movement of the carriage, but is otherwise fixed. The rear connection is both rotatable and slidable. The slidable rear connection accommodates necessary variations in linear distance between the front and rear connections as they follow the chain around a sprocket. In addition, a platen-supporting member of the carriage forms an interior chord across a portion of the sprocket.

19 Claims, 5 Drawing Sheets

100
112
114
116a
116b
116c
116d
116e
116f
118
120
122
124
126
128
130
132
134
138
140
142
144
146
148
150
152
154
156
158
160
162
164
166
168
170
172
174
176
178
190
192
194
196
198
200a
200b
200c
200d
200e
200f
200g
200h
304
392
394
398
406
408
416
x
y
z
3

144
146
178
200b
210
212
214
220
222
224
226
230
232
236
238
240
242
246
248
250
252
254
256
258
272
410
412
440
470
90°
x
y
z

APPARATUS FOR ROTATING A FLAT ARTICLE THROUGH A DESIRED ANGULAR ORIENTATION

BACKGROUND OF THE INVENTION

This invention relates to equipment for manufacturing packages, and more particularly, to apparatus and methods for rotating a flat packaging article presented in a first orientation through a predefined angular displacement to release the article in a second orientation.

A variety of products are transported and distributed in sacks or bags constructed of paper or another strong, but flexible, planar material. Relatively large bags are often required as packaging for pet foods, food stocks, seed, fertilizer, and other products, in quantities from around 10 to 150 pounds. A typical bag constructed for use in such applications comprises an elongate, substantially tubular body section having a top end and a bottom end. A closure is generally provided at each of the top and bottom ends so that product to be contained in the bag does not leak out. Several processes are available for manufacturing such bags.

A bag construction method preferred in the industry is to form the planar material into a flattened "tube" section in a first manufacturing step. At the end of this step, the sides of the bag are complete, but the top and bottom ends are left open. In a subsequent manufacturing step, at least one of the top or bottom ends are closed by sewing, gluing, or another appropriate closure method.

Typical automated manufacturing equipment for performing the first manufacturing step emits the partially completed bags or "tubes" in an end-first orientation. Further, such equipment is typically elongate in shape, and upon exit from the machine, the tube travels in a direction approximately aligned with the longitudinal axis of the machine.

Typical equipment for performing the second manufacturing step (i.e. securely closing at least one end of the tube) requires that the tubes to be processed be presented in a side-first orientation—that is, an orientation approximately perpendicular to the orientation in which they are emitted by the equipment of the first manufacturing step.

For example, in some closure equipment, the component which applies the closure remains stationary, and one of the open ends of the tube is moved across it in a straight-line fashion parallel to the open edge. As a result of the relative motion between the tube and the closure component, the closure component effectively traces a linear path adjacent and parallel to the open end of the tube. Since the path of tube travel is generally aligned with the longitudinal axis of the machine, this configuration requires that the open end of the tube also be aligned along the longitudinal axis of the machine, and the tube must be presented in a side-first orientation to the closure equipment.

Because the second manufacturing step requires the tube in an orientation different than that produced in the first manufacturing step, it has heretofore been difficult to efficiently transfer the tubes at high speed from one process to the next. Tubes may be transferred in single units in a manual operation which includes rotating each tube through the necessary angular displacement. However, such manual transfers are labor-intensive and significantly limit the speed at which tubes may be processed. One proposed solution to this problem is to allow the output of the first process to accumulate in a stacking station, and then to manually transfer the tubes, en masse, to an unstacking station at the input of the second process. This method is also labor intensive, and has the additional disadvantage of requiring complex and expensive equipment to stack and unstack the tubes.

Another possible solution to this problem is to arrange the manufacturing machinery of the first and second processes at right angles (or another suitable angular displacement) with respect to one another, thereby avoiding the need to rotate the tubes. In such an arrangement, tubes produced in the first manufacturing step would automatically be properly oriented for further processing in the second manufacturing step. However, this solution also has several disadvantages. Many existing manufacturing facilities are constructed to accommodate substantially linear arrangements of machinery. Therefore, it may not be convenient to arrange two large manufacturing machines at right angles.

Also, in such an arrangement, although the orientation of the tubes produced in the first manufacturing step is compatible with that required in the second manufacturing step, the tube travel directions are not compatible. Accordingly, tubes which are emitted by the first process, and which may be moving rapidly in a first direction, must first be abruptly stopped and then accelerated in a second direction. Machinery to accomplish these functions is also complex and expensive. In addition, such machinery cannot operate quickly enough to accommodate the maximum operating speeds of other processing equipment. Thus, transfer of tubes between manufacturing steps has become a rate limiting step in the production of completed bags.

A variety of devices have been developed in the past for automatically rotating a tube or other article from a first orientation into a second orientation, through a desired angular displacement.

Auerbach U.S. Pat. No. 4,928,807 discloses an apparatus for turning flat articles such as envelopes. A pair of belts transport the envelope along a deck to a turning position. A rotatable and vertically reciprocable disk member is provided below an aperture in the deck at the turning position. A spring-biased pivot ball is provided above the aperture. When the envelope arrives at the turning position, cams displace the disk member upward through the deck aperture to pin the envelope against the pivot ball at the approximate center of gravity of the envelope. The disk is then rotated by 90 degrees under cam control. The envelope rotates with the disk. Once rotation is complete, the deck pivots upward, and belts and rollers associated therewith engage the envelope to transport it to an exit. DeBarber U.S. Pat. No. 5,207,858 appears to disclose a similar device.

These apparatus require that the article be rapidly accelerated and decelerated, both linearly and angularly. Accordingly, these devices are not suitable for use with articles substantially larger and heavier than an envelope. Applying the Auerbach/DeBarber apparatus to larger, heavier articles would not be feasible, because equipment to accomplish the large accelerations and decelerations required would be costly and complex. In addition, subjecting larger, heavier articles to such accelerations and decelerations may stress the articles and possibly damage them.

Achelpohl U.S. Pat. No. 4,372,436 discloses a tube rotating device employing rotating turntables. A tube forming machine and a base forming machine are adjacently spaced so that tubes being processed therethrough move in parallel but opposite directions. The Achelpohl device employs two rotating turntables and three linear conveyers which cooperate to receive a tube from the tube forming machine, change its direction of movement by 180 degrees, rotate the tube by 270 degrees, and supply it to the base forming machine.

Wojtowics U.S. Pat. No. 3,779,546 discloses another turntable-type device for changing the direction of a document. A rotating wheel has at least one platen for receiving and carrying a document. The platen employs vacuum inlets and a resilient surface to secure the document.

Stemmler U.S. Pat. No. 4,648,503 discloses an article turning device having a pair of closely spaced turntables, each rotating in the same direction and having intersecting article transport paths. Each turntable has a vacuum suction device to retain the article.

Like the devices disclosed by Auerbach and DeBarber, the devices of Achelpohl, Wojtowics, and Stemmler rely on rapid acceleration and deceleration of the article, and therefore suffer from many of the same disadvantages of cost and complexity. In addition, although the Achelpohl device may accommodate large articles, it does not operate quickly enough to match the speed of modern bag production equipment. In addition, Achelpohl does not accommodate an end-to-end arrangement of equipment for performing the first and second manufacturing steps.

Rochla U.S. Pat. No. 3,587,824 discloses an article for turning flat workpieces as they advance. A deck is provided which extends longitudinally in the direction of workpiece travel. The deck has a longitudinal opening along its length. Upper and lower conveyers are provided to synchronously convey a plurality of turning devices. Each conveyer includes a spaced pair of continuous chain loops with end sprockets. Each turning device includes a turntable mounted on a carriage assembly; each carriage appears to be attached to the chains at a single location. The upper and lower conveyers move synchronously so that the turntables cooperatively engage workpieces at one end of the deck and transport them to the other end. A cam controls the position of the turntable with respect to the carriage to avoid interference between the edge of a turntable and the workpiece or opposing turntable. The turning devices of at least one of the conveyers are cam driven to cause rotation of the workpiece. Von Hein U.S. Pat. No. 4,565,359 appears to disclose a device having many similarities to that of Rochla.

The Rochla and Von Hein devices are difficult to construct due to the complexity of synchronizing upper and lower conveyers. In addition, the Rochla device requires a complicated mechanism for controlling the vertical positions of the turntables as they approach the workpiece and table.

OBJECTS AND SUMMARY OF THE INVENTION

It is therefore an object of the present invention to provide a device for directly transferring a large, flat article from a manufacturing process which emits the article in a first angular orientation to a manufacturing process which requires the article to be presented in a second orientation.

It is another object of the invention to provide a device for rotating a bag or other large flat article through a predetermined angular displacement without subjecting the article to large accelerations.

It is a further object of the invention to provide a device for rotating a bag or other large flat article through a predetermined angular displacement while substantially maintaining its direction of travel.

It is another object of the invention to provide a device for rotating a bag or other large flat article through a predetermined angular displacement having simpler construction than prior art designs.

It is a further object of the invention to provide a device for rotating a bag or other large flat article through a predetermined angular displacement capable of operating at production rates compatible with modern manufacturing equipment.

The present invention provides a device for rotating a partially manufactured bag, or other substantially planar article, through a predefined angular displacement within the plane in which the article resides, while simultaneously translating the bag along a linear path. The inventive machine comprises a flat, low-friction table surface on which a workpiece is slidably supported as it is transported through the machine, and a plurality of conveyer-driven platens for transporting and rotating the workpiece. The machine receives a flattened paper "tube" (a paper bag in an intermediate stage of manufacture) at an infeed conveyer, and places it on the table surface. A set of spaced platen carriage assemblies are provided on a chain-driven conveyer which extends along the tube transport path. As a tube is placed onto the tabletop, the platen carriage assembly approaches the tube. A platen component thereof lowers onto the tube, frictionally engages it, and transports it linearly along the table top. A cam mechanism responsive to the linear position of the platen carriage assembly slowly rotates the platen, and with it, the tube, through a predefined angular displacement, such as 90 degrees, as the platen and tube are transported toward the exit.

The conveyer drive is implemented as a spaced pair of continuous chain loops which extend along the length of the table. Each chain rides between a pair of sprockets at opposite ends of the table. The platen carriage assemblies comprise a rotatable platen component supported by a structural carriage. Each carriage is connected to the chains at two positions. A bar member of the carriage extends from the front connection position through the rear connection position and some distance beyond it. The front connection is rotatable about an axis transverse to the direction of movement of the carriage, but is otherwise fixed. The rear connection is provided by a rod which rides in a slot formed in the bar member. The movement of the rod in the slot advantageously accommodates necessary variations in linear distance between the front and rear connections as they follow the chain around a sprocket. Thus, the bar forms a interior chord across a portion of the sprocket.

Because the platen is supported by the carriage bar at a position on the interior chord, its position with respect to the drive chain varies. In particular, as the carriage rotates around the sprockets at each end of the conveyer, the radius of rotation is automatically reduced. This advantageously prevents interference between the platen disk and the tube or table surface, and causes the platen disk to gradually approach or recede from the surface.

BRIEF DESCRIPTION OF THE DRAWINGS

These and other features of this invention will be best understood by reference to the following detailed description of a preferred embodiment of the invention, taken in conjunction with the accompanying drawings, in which.

DETAILED DESCRIPTION OF THE PREFERRED EMBODIMENT

A preferred embodiment of a device 100 for rotating large flat articles, constructed according to the present invention, is shown generally in FIGS. 1–6. Orthogonal coordinate axes X, Y, and Z are provided in FIGS. 1–6 to clarify the orientation of the device 100 in each view.

It is believed that the present invention is particularly useful for rotating a flattened bag or sack container in an intermediate stage of manufacture. Accordingly, the article 116 to be rotated is typically referred to herein as a "bag." However, it will be appreciated that the present invention may also be applied in a wide range of other environments in which rotation of a relatively flat article is desired. In addition, although the article to be rotated is described herein as "flat", the present invention may be used to rotate articles having substantial thickness provided that the article has a suitable bottom surface and overall geometry to allow it to be slidably urged along a flat, low-friction surface without tipping over.

I. Overview

Figure 1:
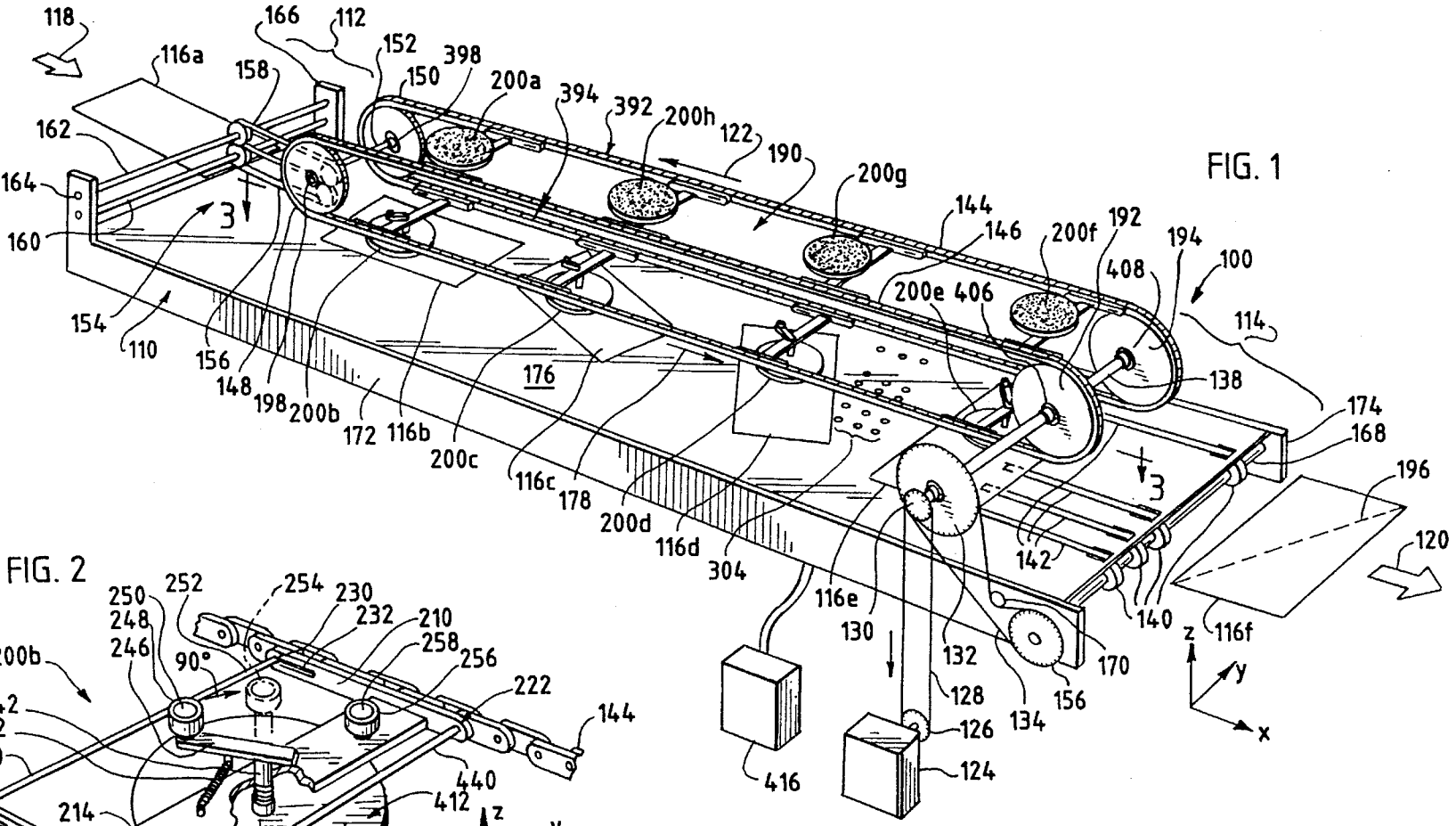
FIG. 1 is an oblique perspective view of an article rotating apparatus constructed according to the present invention, in which view certain structural elements of the apparatus are omitted for clarity.
Figure 4:
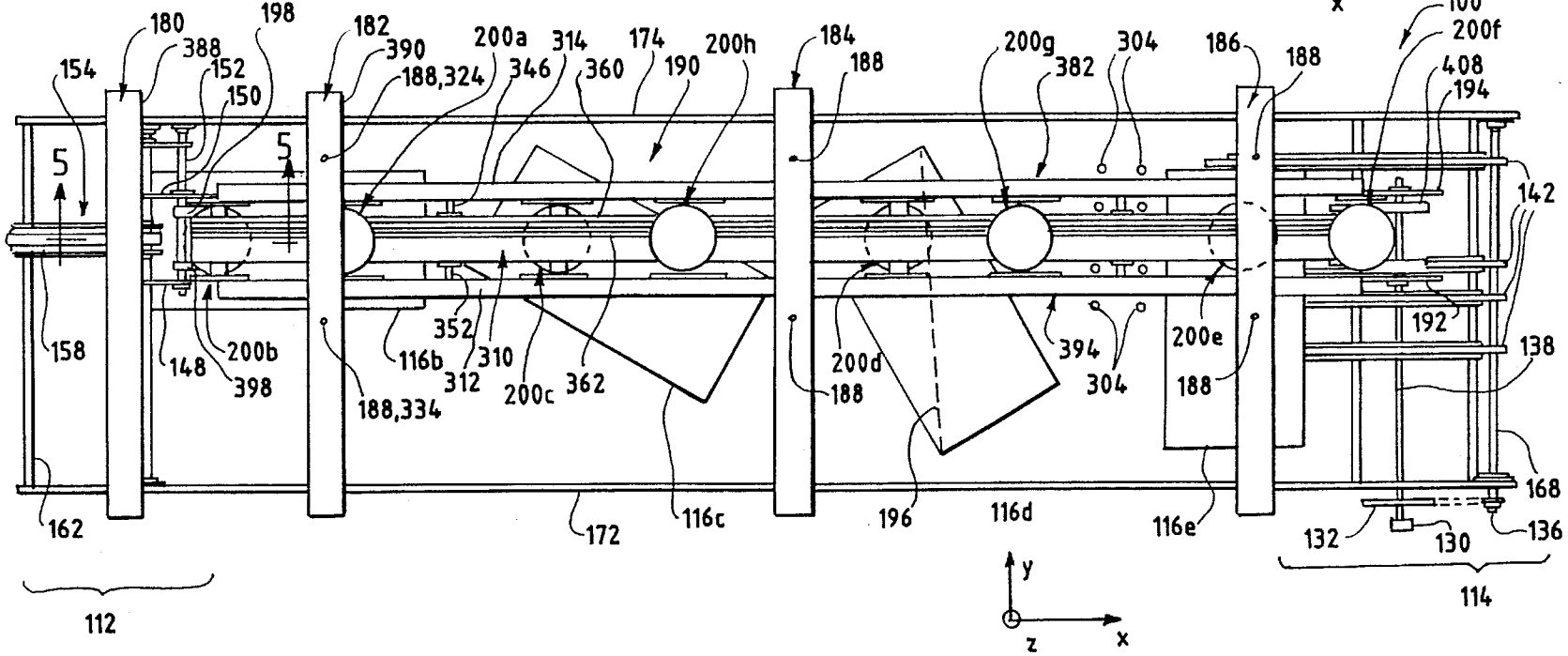
FIG. 4 is a top plan view of the article rotating apparatus of FIGS. 1–3.

An overview of the inventive article rotating machine 100 may be best seen in FIGS. 1 and 4. The article rotating machine 100 comprises a table 110, a primary bag conveyer 190 disposed above table 110, an infeed station 112 at a first end of the table 110, and an outfeed station 114 at the opposite end of the table 110. The machine 100 also further comprises a structural framework (omitted from the view of FIG. 1 to avoid obscuring other components) to support the table 110, conveyer 190, and related components. The table 110 provides a flat, slippery surface 176 upon which the bags 116 are supported as they travel through the machine 100. Bags 116 travel through the machine 100 in the direction of arrows 118 and 120.

The infeed station 112 receives a bag 116 in a first angular orientation from an external source (not shown) and presents it to the primary bag conveyer 190. The primary bag conveyer 190 (hereafter, the "conveyer") linearly translates the bag 116 along the table surface 176 from the infeed station 112 to the outfeed station 114.

The term "bag plane" is used herein to refer to the plane in which the bag travels. Because the bags are slidably transported across the table surface 176, the bag plane is generally parallel to that surface and to the X–Y plane.

In addition to and simultaneous with its linear translation of the bag 116, the conveyer 190 slowly rotates the bag 116 through a predetermined angular displacement about an axis perpendicular to the bag plane. The outfeed station 114 receives the rotated bag 116 and presents it to a receiving facility or device (not shown) for further processing.

In the preferred embodiment of FIGS. 1–6, the bags are rotated 90 degrees about an axis perpendicular to the bag plane. However, it will be appreciated that slight modifications will permit the inventive machine 100 to rotate articles through any desired angular displacement.

The conveyer 190 is disposed above the table surface 176 and comprises a pair of chain drive assemblies extending longitudinally above the table surface 176 between the infeed station 112 and the outfeed station 114. The chain drive assemblies are spaced along the Y axis. The chain drive assemblies include a first conveyer chain 144 and supporting drive sprockets 150, 194, and a second conveyer chain 146 and supporting drive sprockets 148, 192. A plurality of platen carriage assemblies 200 (FIGS. 1–2, 2*a*, and 4–6) are attached to the conveyer chains 144 and 146, and extend therebetween, at spaced intervals along the length of the chains. Thus, the platen carriage assemblies 200 are driven by the conveyer chains 144, 146.

The platen carriage assemblies 200 (FIGS. 2 and 2*a*) each comprise a disk-shaped platen 238, and a carriage 410 for supporting the platen and attaching it to the conveyer chains 144, 146. The platen 238 is rotatably mounted on a portion 214 of the carriage 410. A cam follower 248 controls the rotational or angular position of the platen 238. A cam surface 262 (FIGS. 3, 5, and 6) extending substantially longitudinally along a portion of the conveyer 190 operates on the cam follower 248 as the platen carriage assembly 200 moves from the infeed 112 station to the outfeed station 114.

The cam surface 262 and the cam follower 248 cooperate to rotate the platen 238 through a predefined angular displacement, such as 90 degrees, as the platen carriage assembly 200 travels the length of the table surface 176. In operation, the platen 238 engages a bag 116 supplied at the infeed station 112, slides it linearly along the table surface 176 toward the outfeed station 114, and simultaneously rotates it by the desired angular displacement 236.

II. Table and Machine Support Structure

Figure 5:
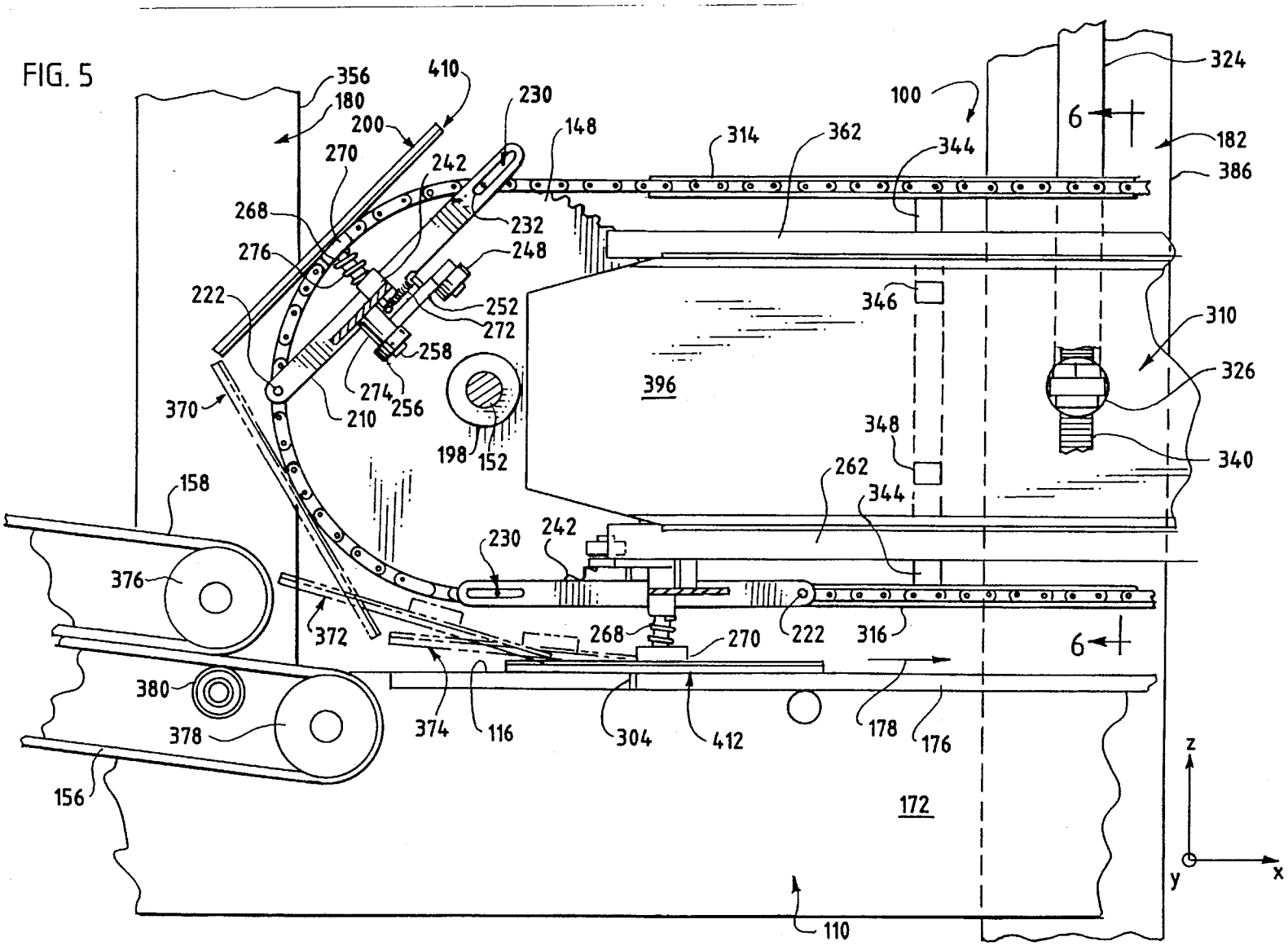
FIG. 5 is a partial side cross section view of the infeed region of the article rotating apparatus of FIGS. 1–4, taken along the view lines 5—5 of FIG. 4.

Table 110 provides a large, low friction surface for supporting bags 116 as they travel through the machine 100. As best seen in FIGS. 1, 4, and 5, table 110 comprises a top surface 176 and two side members 172 and 174. The top surface 176 is a horizontal, substantially planar surface extending longitudinally (i.e. in the direction of bag movement shown by arrow 178 and parallel to the X–Y plane) from the infeed station 112 to the outfeed station 114.

The top surface 176 preferably has a substantial width in the Y direction. While the exact width of the top surface 176 is not critical, it must be large enough to support the bags 116 as they are translated and rotated through the machine. Accordingly, the width of the top surface is preferably at least as large as the hypotenuse or diagonal line 196 (FIGS. 1 and 4) joining diagonally opposite corners of the largest bag to be processed by the machine 100. In addition, as will be explained further, bags 116 are rotated about an axis which may not be located at the bag's center of gravity or other central point. Accordingly, depending on the size of the bags to be processed, additional top surface width may be required to accommodate the off-center excursion of the bag.

The top table surface 176 may be constructed of any suitable sturdy, durable, low friction material. According to one aspect of the present invention, bags 116 are engaged by platens 238 and slidably urged along through the machine along the table surface 176. Accordingly, movement of a bag 116 through the inventive machine 100 requires that the bag experience a high coefficient of friction with respect to an engaging surface of the platen 238 (FIGS. 2 and 2*a*), while experiencing a relatively low coefficient of friction with respect to the table surface 176.

The platens 238 have a facing pad 240 selected to enhance frictional engagement with the bags 116. Therefore, the material appropriate for the table surface 176 depends largely on the material from which bags 116 are constructed. In addition, there may be certain times during which the machine is operated without bags, such as during installation, maintenance, and testing. At such times, the platen facing pads 240 directly contact the table surface 176 and move slidably along it. Accordingly, the table surface material is preferably selected to minimize friction between it and the platen facing pads 240. This avoids excessive wear on these components and prevents the machine from seizing or binding.

For machines processing typical bags formed from coated paper, uncoated paper, and many plastics, the table surface 176 may be constructed of a suitable grade of stainless steel or another appropriate material. In some applications, a low-friction coating 302 (FIG. 6) may be advantageously provided on the table surface 176.

However, in some cases, the weight of the bag, its exterior surface, or some other characteristic may make it difficult to slidably transport the and rotate the bag along the table surface 176. An air flow cushion may be provided on the table surface to further reduce friction. The air flow cushion may be achieved by forming a plurality of small apertures 304 (FIGS. 1, and 4–6) in the table surface, and providing pressurized air to the side of the table surface 176 opposite the bag. The pressurized air is expelled from the surface to form a stream or cushion of air which supports the bag as it moves, thereby reducing the friction between the bag and the table surface.

Any suitable source 416 (FIG. 1) of compressed air (or other appropriate gas) may be used to provide the air cushion. The air may be distributed to the apertures 304 using any appropriate means. For example, a separate tube 306 (FIG. 6) may be used to supply each aperture. Alternatively, an air plenum space 308 (FIG. 6) may be provided under the table surface to provide a common air supply for the apertures 304. Means may be provided to selectively operate the air cushion along only that portion of the table surface over which a bag is presently located, in order to reduce the pressure or flow rate at which the air must be supplied.

In an alternative preferred embodiment, an additional conveyor (not shown) may be provided. The additional conveyor is preferably similar to conveyor 190, but is disposed below the table surface 176 in an inverted vertical orientation (i.e. an orientation opposite that of conveyer 190). The additional conveyor operates in synchronism with conveyor 190. A longitudinally extending slot (not shown) is preferably formed in the table surface 176 to allow the platens of the additional conveyor to meet those of conveyor 190. In this alternative embodiment, bags to be rotated would be securely gripped by the opposing mating platens of the two conveyers. The portions of the table surface 176 adjacent to the slot would continue to support the parts of the bag which extend outwardly from the platen. This alternative embodiment of the invention would otherwise operate in the same manner as the first preferred embodiment.

In all embodiments, suitable side members 172 and 174 (FIGS. 1, 4, and 5) may be provided to support the table surface 176. The side members 172, 174 descend vertically from the outside longitudinal edges of the table surface 176. First and second structural members 164 and 166 extend upward from side members 172 and 174, respectively, to support components 160, 162 of the infeed conveyer 112.

An external frame is provided to support the machine 100. The external frame includes a plurality of inverted rectangular U-shaped structural members 180, 182, 184, and 186 (FIG. 4) which are spaced along the length of the table 110. Each of the structural members 180, 182, 184, 186 comprises a pair of vertical support legs and at least one cross member spanning the top of the legs. For example, structural member 180 comprises vertical support legs 356 (FIG. 5) and cross member 388 (FIG. 4), and structural member 182 comprises vertical support legs 386 (FIG. 5) and cross member 390 (FIG. 4). The external frame may further comprise additional bracing or other structural members (not shown) as required. The external frame members are omitted from FIG. 1 to avoid obscuring other components. The table side members 172, 174 are mechanically attached to and supported by the external frame members 180, 182, 184, and 186. Cross members (not shown) joining the table side members 172, 174 may be provided for additional structural support.

Figure 6:
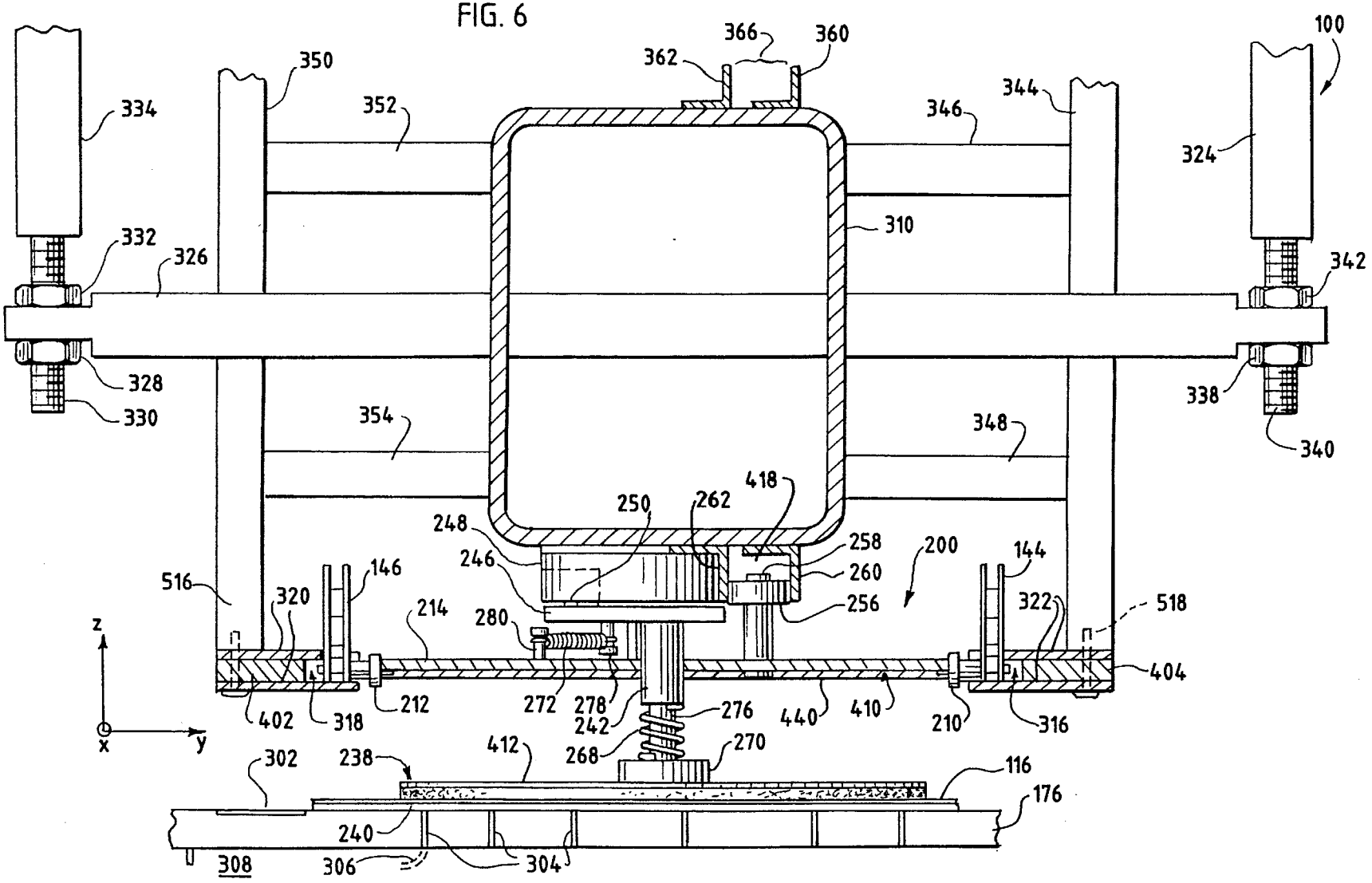
FIG. 6 is a front cross section view of the article rotating apparatus of FIGS. 1–5, taken along the view lines 6—6 of FIG. 5.

As best seen in FIGS. 5 and 6, the primary bag conveyer 190 is supported by a longitudinally extending conveyer support member 310 disposed above the table 110. The conveyer support 310 may have any appropriate cross section shape which provides the desired structural strength and rigidity. For example, as best seen in FIG. 6, the conveyer support 310 cross section may be a rectangle with slightly rounded corners, but other shapes could also be used.

The conveyer support 310 is supported by a plurality of horizontal cross members. The horizontal cross members may be attached in any appropriate matter to the conveyer support 310. For example, the horizontal cross members may extend through the conveyer support 310, as shown in the Figures, or may be bolted or welded to the outside of the support member. The cross members are attached to the external frame members 180, 182, 184, and 186 by vertical suspension elements 188 (FIG. 4) which descend from the upper horizontal sections of external frame members 180, 182, 184, and 186. For example, cross member 326 (FIGS. 5–6)is supported by suspension elements 324 (FIGS. 4–6) and 334 (FIGS. 4 and 6) descending from the upper cross member 390 (FIG. 4) of external frame member 182 (FIGS. 4–5).

As best seen in FIG. 6, the suspension elements (e.g. elements 334 and 324) preferably have adjustable means for mechanically attaching to the horizontal cross members (e.g. 326). This permits adjustment of the vertical position at which the conveyer support 310 is suspended. For example, suspension elements 334 and 324 have end portions 330, 340 which are threaded to receive upper fasteners 332, 342, and lower fasteners 328, 338, respectively. The position of cross member 326 may be controlled by adjusting the position of the fasteners 332, 342, 328, and 338. Any suitable fastener means compatible with the end portions 330, 340, such as conventional threaded nuts, may be used. Other suitable configurations for attaching the horizontal cross members to the vertical suspension elements could also be used.

The primary bag conveyer 190 includes spaced right and left drive chains 146, 144 respectively, which extend parallel to the conveyer support 310, on opposite sides thereof, from drive sprockets 148, 150, 192 and 194 located at the ends of the table 110. Each of the drive chains are formed as continuous loop chains which follow the curvature of their respective drive sprockets but otherwise extend substantially linearly therebetween. Four chain guides 312, 314, 316, and 318 are provided to support and guide the drive chains 146, 144 along the linear portions of the drive chain paths. As best seen in FIGS. 5 and 6, the chain guides are mechanically attached to the conveyer support 310 by a structural framework. The framework comprises a plurality of horizontal members such as 346, 348, 352 and 354 extending outwardly from the conveyer support, and a plurality of vertical connecting members such as 344 and 350 which are attached to the horizontal members and which support the chain guides.

The components of the chain guide support framework may be mechanically secured to the conveyer support 310, to the chain guides, and to each other by any suitable means. For example, the framework components may be attached to the conveyer support 310 and to each other by welding. The chain guides may be attached to the vertical connecting members 344 and 350 by appropriate fasteners 516, 518 (FIG. 6). Fasteners 516, 518 may be threaded bolts secured in tapped sockets. Other fasteners or attachment means could also be used.

III. Bag Conveyer

The primary bag conveyer 190 includes a plurality of moving platen carriage assemblies 200 for transporting bags 116 along the table surface 176 and for simultaneously rotating the bags 116 through a desired angular displacement.

As best seen in FIGS. 1, 4, and 6, the conveyer 190 is disposed above the table surface 176. The conveyer 190 includes spaced right-hand and left-hand chain drive assemblies 394 and 392 (FIGS. 1 and 4) respectively (as viewed by an observer looking at the machine in the direction of bag movement).

The right-hand chain drive assembly 392 comprises a right-hand drive chain 146, and a pair of drive sprockets 148 and 394, respectively located adjacent the infeed station 112 and the outfeed station 114. The left-hand chain drive assembly 192 similarly comprises a left-hand drive chain 144, and a pair of drive sprockets 150 and 194, respectively located adjacent the infeed station 112 and the outfeed station 114. The drive chains 146 and 144 form a continuous loop or circuit extending parallel to the conveyer support 310 (FIGS. 5–6) and disposed on opposite sides thereof.

Each of the drive chains 146 and 144 are formed as continuous loop chains which follow the curvature of their respective drive sprockets but otherwise extend substantially linearly therebetween. The drive chains 146 and 144 preferably reside in planes parallel to each other and to the X–Z plane. The chains 146, 144 are preferably driven synchronously. Because the chains reside in parallel planes and the chains are driven synchronously, a selected point on chain 144 is located at a fixed distance from a corresponding point on chain 146 throughout operation of the machine.

A plurality of platen carriage assemblies 200*a*–200*h*, collectively designated herein using the reference number 200 (FIGS. 1–2, 2*a*, and 4–6), are attached to the drive chains 144 and 146, and extend therebetween, at spaced intervals along the length of the chains. In normal operation, drive sprockets 192 and 194 rotate counter-clockwise (in the view of FIG. 1), thereby driving chains 146 and 144 in the directions indicated by arrows 178 and 122. Since the platen carriage assemblies 200 are attached to the conveyer chains 144, 146, the platen carriage assemblies 200 trace a continuous counter-clockwise circuit from the infeed station 112 to the outfeed station 114 and back again.

The conveyer 190 receives bags 116 supplied one-by-one from the infeed station 112. The arrival of each bag 116 at the infeed end of the conveyer 190 is preferably timed to coincide approximately with the arrival of one of the platen carriage assemblies 200. FIG. 5 shows the movement of a platen carriage assembly 200 in several successive positions 410, 370, 372, 374 and 412 as it follows chains 144 and 146 counter-clockwise around the sprockets 148 and 150. A bag 116 has been deposited on the on the table surface 176 by the infeed conveyer 112. The platen carriage assembly 200 approaches a bag 116 from the upper left, frictionally engages its upper surface, and urges it slidably along the table surface in the direction of arrow 178.

Sprockets 148 and 150 are mounted for rotation on an axle 152. Axle 152 is supported at an end of the conveyer support 310 by bearings 398 and 198. Sprockets 192 and 194 are mounted for rotation on an axle 138. Axle 138 is supported at an opposite end of the conveyer support 310 by bearings 406 and 408. Bearings 198, 398, 406, and 408 may use any appropriate bearing technology. For example, bearings 198, 398, 406, and 408 may be commercially available ball bearing assemblies of sufficient capacity to support the load of the sprockets, conveyer chains, and platen carriage assemblies. A suitable ball bearing for use in this application is available from Dodge, 2 Roper Ct., P.O. Box 499, Greenville, S.C. 49602, as part number 124276.

The sprockets 148, 150, 192, and 194 provide several functions. They partially support the drive chains in a desired vertical position. In addition, they help-maintain the drive chains in a desired spaced horizontal relationship. Further, at least one set of the sprockets, such as the sprockets 192, 194 adjacent to outfeed station 114, are used to drive chains 146 and 144 and the platen carriage assemblies 200 associated therewith. As best seen in FIGS. 1 and 4, a drive mechanism is provided to couple rotating mechanical energy to drive sprockets 192 and 194.

An energy source 124 provides rotating mechanical energy to be coupled to the drive sprockets 192 and 194. In a typical manufacturing environment, the equipment of the first manufacturing step, the bag rotating machine 100, and the equipment of the second manufacturing step, all must operate synchronously. Accordingly, in a commercial embodiment of the invention, the energy source 124 is preferably a synchronous drive of the servo type. However, depending on the application environment, another suitable source, such as a conventional electric motor, a hydraulic motor, a pneumatic motor, or an internal combustion engine could be used. In some applications, the production line equipment, including the inventive machine 100, could be driven by a common drive shaft, eliminating the need for a separate energy source 124.

It is noted that an article turning machine 100 constructed according to the present invention may vary in length, operational speed, number of platen carriage assemblies, maximum bag length, and other design parameters. The power required from the energy source 124, and certain other energy source specifications may vary according to such parameters.

One embodiment of the invention has been constructed having a length of approximately 22 feet, an operational speed greater than 200 bags per minute, eight platen carriage assemblies, and a maximum bag size of approximately 52 inches in length by 24 inches in width. In that embodiment, a 7.5 horsepower electric motor, having an operating speed of 1750 RPM under load, was used as energy source 124 and performed satisfactorily.

The source 124 delivers its energy via a sprocket 126 (FIG. 1). Axle 138 (FIGS. 1 and 4), to which drive sprockets 192 and 194 are attached, preferably extends outward to receive energy coupled from the source 124. A sprocket 130 is provided on the axle 138 and is coupled to the source sprocket 126 by any suitable drive means 128. For example, drive means 128 may be implemented as a conventional drive chain, or a webbed means, such as an ordinary belt or a toothed or grooved timing belt.

As noted above, each of the drive chains are formed as continuous loop or circuit of link elements which follow the curvature of their respective drive sprockets but otherwise extend substantially linearly therebetween. Four chain guides 312, 314, 316, and 318 are provided to support and guide the drive chains 146, 144 along the linear portions of the drive chain paths. Upper-right chain guide 312 (FIG. 4) and lower-right chain guide 318 (FIGS. 4 and 6) are provided to support the right-hand drive chain 146. Upper-left chain guide 314 (FIGS. 4 and 5) and lower-left chain guide 316 (FIGS. 5 and 6) are provided to support the left-hand drive chain 144.

As best seen in FIG. 6, the lower chain guides 316, 318 are respectively constructed as a vertically spaced pair of horizontal planar members 320, 322 extending along a substantial portion of the linear part of the chain path. Spacing elements 402, 404 are interposed between individual members of the pair to provide a predetermined spacing therebetween. Upper chain guides 312, 314 are similarly constructed. The chain guides provide a secure channel in which the drive chains 146, 144 are constrained, thereby accurately locating the drive chains in a desired position. Since the platen carriage assemblies 200 are supported and moved by the drive chains, the chain guides effectively constrain the platen carriage assemblies to move along desired carriage movement paths.

Although drive chains 144 and 146 are described herein as "chains," which are conventionally implemented as a continuous loop or circuit of articulated, interlocking link segments, the drive chains could also be implemented using any other suitable drive means. For example, the drive chains 144 and 146 could be implemented using bands, cables, or various webbed means, such as timing belts or conventional belts. The drive chains must be sturdy enough to carry the platen carriage assemblies 200. In addition, since the drive chains must be driven synchronously, means must be provided for ensuring that the chains cannot slip with respect to one another or to the drive sprockets. If drive means other than conventional chains are used, small modifications may be required to the drive sprockets and to the platen carriage assembly attachment means to render these components compatible with the drive means.

IV. Infeed and Outfeed Stations

An infeed station 112 receives bags 116 to be processed by the inventive machine 110 in a first angular orientation and provides them, one-by-one, to conveyer 190. The infeed station 112 may comprise any suitable conveyer means 154. For example, as best seen in FIGS. 1, 4, and 5, conveyer means 154 may comprise an upper conveyer belt 158, a lower conveyer belt 156, a first set of upper and lower axles 162 and 160 with pulleys for supporting the belts at a first end, and a second set of upper and lower axles 376, 378 for supporting the belts at an opposite end. In operation, bags 116 are fed between upper conveyer belt 158 and lower conveyer belt 156. Conveyer means 154 is preferably driven using the same source 124 as the rest of machine 100. For example, a drive axle and an associated wheel 380 may be placed in mechanical contact with lower belt 156. The drive axle and wheel may be conventionally driven from drive axle 152 using any suitable gears, chains, belts, or the like. Since sprockets 148 and 150 are mounted on axle 152, the axle is effectively driven by the drive chains 144 and 146.

An outfeed station 114 receives bags 116, which have been rotated in the machine 100 through the desired angular displacement, and presents it to a receiving facility or device for further processing. The outfeed station 114 may comprise any suitable conveyer means. For example, as best seen in FIGS. 1 and 4, a plurality of conveyer belts 140 may extend upward a small distance through apertures 142 in table surface 176. The outfeed conveyer means is preferably driven using the same drive energy source 124 as the rest of machine 100. For example, the belts 140 may be driven by a shaft 168 having suitable drive pulleys. The shaft 168 may be driven from the axle 138 which supports sprockets 192 and 194, by means of a drive belt or chain 134 and auxiliary sprockets 132, 136, and 170.

V. Platen Carriage Assembly

As noted above, in normal operation, the primary bag conveyer 190 slidably translates bags from the infeed station 112 to the outfeed station 114 in the direction of arrows 118 and 120 (FIG. 1). In addition to and simultaneous with its linear translation of the bag 116, the conveyer 190 slowly rotates the bag 116 through a predetermined desired angular displacement about an axis perpendicular to the bag plane. The conveyer 190 includes a plurality of moving platen carriage assemblies, collectively designated herein using the reference number 200 (FIGS. 1–2, **2*a*, and 4–6), for accomplishing both the linear translation and angular rotation. The platen carriage assemblies are attached to the conveyer drive chains 144,146**.

For illustration, eight platen carriage assemblies **200*a*–200*h* are shown in FIG. 1, but any reasonable number of platen carriage assemblies may be used in a machine constructed according to the present invention. However, the separation along the chains 144, 146 between adjacent platen carriage assemblies 200 must be large enough to avoid interference between the bags being rotated by the adjacent platens. Accordingly, the number of platen carriage assemblies is limited by the length of table 110 and drive chains 144, 146, and by the size of the largest bags which the machine 100** is intended to accommodate.

Figure 2:
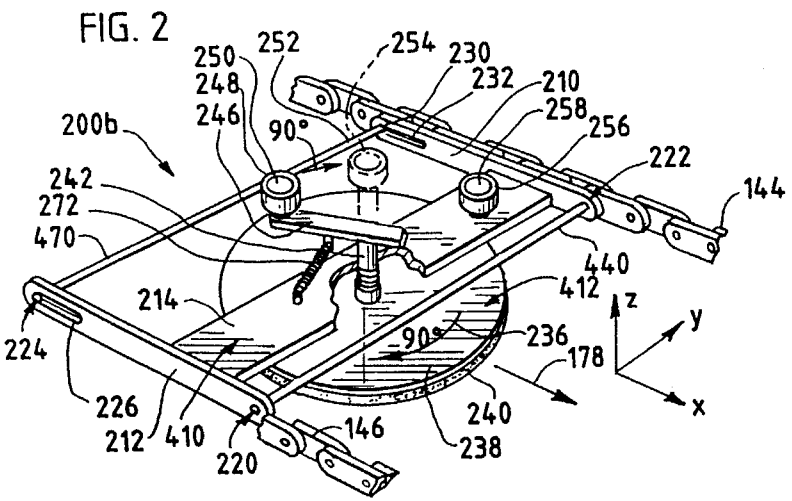
FIG. 2 is an oblique top perspective view of a platen carriage assembly for use in the article rotating apparatus of FIG. 1.
Figure 2A:
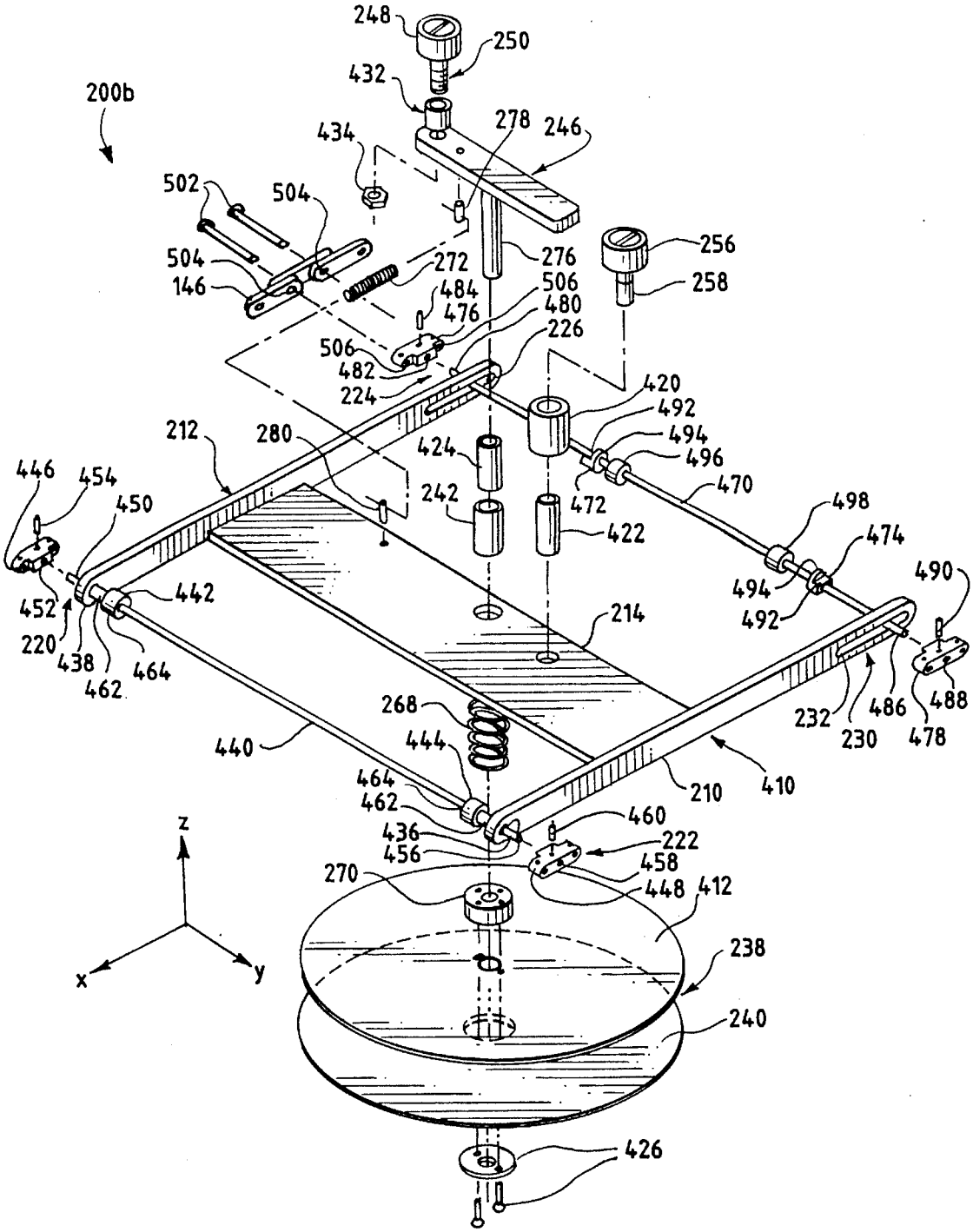
FIG. 2*a* is an oblique top exploded perspective view of the platen carriage assembly of FIG. 2, showing the assembly rotated by approximately 90 degrees from the position shown in FIG. 2.

The construction of a platen carriage assembly 200 is best seen in FIGS. 2, **2*a*, 5, and 6. FIG. 2 is an oblique perspective view of a platen carriage assembly 200*b* (FIG. 1, 2, and 2*a*) from above, showing the assembly in a position in which the platen thereof is facing table surface 176. FIG. 2*a* is an exploded perspective view of platen carriage assembly 200*b* showing the assembly rotated by approximately 90 degrees from the position shown in FIG. 2. The remaining platen carriage assemblies may be identically constructed. The platen carriage assembly 200 comprises a platen 238 and a carriage 410 for supporting the platen and providing a mechanical attachment to conveyer chains 144 and 146. The carriage 410 comprises a first leg member 210, a second leg member 212, and a cross member 214 attached to and joining the first and second legs 210, 212**.

First and second leg members 210 and 212 are preferably formed as straight bar-shaped structures of a sturdy material. First leg member 210 is attached to drive chain 144 at front and rear chain attachment means 222 and 230 respectively. Second leg member 212 is attached to drive chain 146 at front and rear chain attachment means 220 and 224 respectively.

The rear attachment means 224 and 230 are preferably pivotal and slidable attachment means which permit the leg members 210, 212 to rotate about an axis extending through the attachment means and parallel to the Y-axis, and which also permit limited longitudinal movement of the leg members with respect to the chain. Any suitable attachment means may be used.

The front attachment means 220 and 222 are preferably pivotal attachment means which permit the leg members 210, 212 to rotate about an axis extending through the attachment means and parallel to the Y-axis, but which prohibit substantial lateral or longitudinal movement of the leg members with respect to the chain. Any suitable pivotal attachment means may be used.

For example, as best seen in FIG. 2*a*, the rear attachment means 224 and 230 may be constructed by providing small connecting members 476 and 478 to form mechanical connections between the drive chains 146 and 144 and the rear portions of carriage leg members 212 and 210, respectively. The front attachment means 220 and 222 may be constructed by providing connecting members 446 and 448 to form mechanical connections between the drive chains 146 and 144 and the front portions of carriage leg members 210 and 212, respectively.

Connecting member 476 may be secured to chain 146 by suitable fastening pins 502. Pins 502 preferably extend through apertures 504 provided in two proximately located links of chain 146 and into receiving apertures 506 provided in the connecting member 476. The pins 502 may be adjustably secured in receiving apertures 506 using any suitable means, such as set screws. Heads of enlarged diameter on pins 502 on the side opposite the connecting member capture the chain on the pins between the heads and the connecting member 476. To avoid obscuring other components, only a portion of drive chain 146 adjacent rear attachment means 224 is shown in FIG. 2*a*, and drive chain 144 is omitted. Therefore, only the mechanical connection between connecting member 476 and drive chain 146 is shown. However, the connections between connecting members 478, 456, and 458, and their respective drive chains, may be similarly constructed.

Rear connecting members 476 and 478 are preferably secured to carriage leg members 212 and 214, respectively by a dowel or rod 470 which spans the leg members 212 and 214 and extends through respective longitudinal slot apertures 226 and 232 thereon. Rod 470 has a first end 480 which extends into a receiving aperture 482 in connecting member 476 and is secured therein with a suitable fastener 484. Rod 470 has a second end 486 which extends into a receiving aperture 488 in connecting member 478 and is secured therein with a suitable fastener 490. Fasteners 484 and 490 may be any suitable fastener, such as a roll pin or a set screw. Since rod 470 is captured between connecting members 476 and 478 and passes through slots 226 and 232, these elements cooperate to effectively secure the connecting members 476, 478 to leg members 212, 214 respectively.

Grommets 472 and 474 are mounted on rod 470 to provide slidable bearing surfaces between rod 470 and slots 226, 232 respectively. Each grommet has a flattened section 492 which enters the respective slot, and an enlarged-diameter section 494 which cannot enter the slot. Retaining washers 496 and 498 secure the grommets 472 and 474 in desired positions on rod 470. The grommets 472 and 474 allow rod 470 to rotate about its longitudinal axis and to move slidably within grooves 226, 232, while minimizing wear between the rod and the grooves.

Front connecting members 446 and 448 are preferably secured to carriage leg members 212 and 214, respectively by a dowel or rod 440 which spans the leg members 212 and 214 and extends through respective circular apertures 438 and 436 thereon. Rod 440 has a first end 450 which extends into a receiving aperture 452 in connecting member 446 and is secured therein with a suitable fastener 454. Rod 440 has a second end 456 which extends into a receiving aperture 458 in connecting member 448 and is secured therein with a suitable fastener 460. Fasteners 454 and 460 may be any suitable fastener, such as a roll pin or a set screw. Since rod 440 is captured between connecting members 446 and 448 and passes through slots 438 and 436, these elements cooperate to effectively secure the connecting members 446, 448 to leg members 212, 214 respectively.

Grommets 442 and 444 are mounted on rod 440 to provide pivotal bearing surfaces between rod 440 and apertures 446, 448 respectively. Each grommet has a reduced-diameter section 462 which enters the respective aperture, and an enlarged-diameter section 464 which cannot enter the aperture. The grommets 442 and 444 allow rod 440 to rotate about its longitudinal axis within apertures 446, 448, while minimizing wear between the rod and the apertures.

In addition to forming a mechanical attachment between the connecting members 476, 478, 456, and 458 and leg members 212 and 214, rods 440 and 470 also advantageously maintain chains 144, 146 at a desired horizontal spacing. This substantially eliminates the effects of rotational forces which might otherwise tend to disrupt the spacing of the chains.

Although the front attachment means 220, 222 is shown in the drawings and described herein as a pivotal attachment, and the rear attachment means 224, 230 is shown as a pivotal and slidable attachment, the conveyor would also operate satisfactorily if the order of the attachments were reversed. Thus, the advantages, described in detail below, provided by the combination of exclusively pivotal attachments at one end of the carriage leg members 210, 212 with pivotal and slidable attachments at the opposite end of the leg members, would also be achieved in an alternative embodiments having a pivotal and slidable front attachment means and an exclusively-pivotal rear attachment means.

Figure 3:
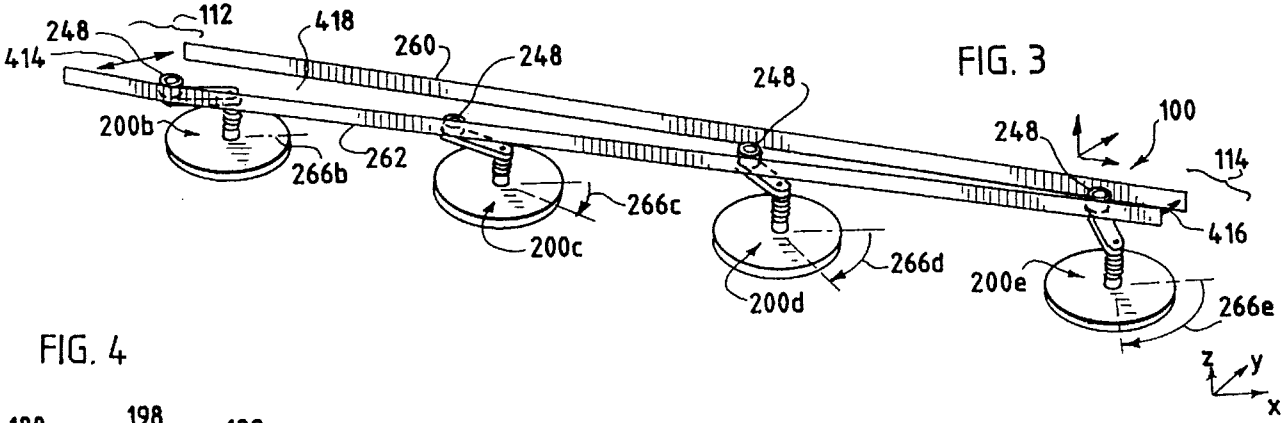
FIG. 3 is a perspective view of a segment of the apparatus of FIG. 1 and indicated by view lines 3—3 thereof, including several platen assemblies and certain associated cam surfaces which are used in the present invention to control the angular position of the platens.

The cross member 214 is preferably constructed as a plate member joining leg members 210 and 212. As best seen in FIGS. 3, 5, and 6, a platen 238 is mechanically mounted to the cross member 214 for limited rotation about an axis perpendicular to the cross member. The platen 238 preferably comprises a disk-shaped plate member 412, a facing pad 240, a mounting base 270 with associated fastening hardware 426, a support shaft 276, a support bearing means 242 and 424, a crank member 246, a cam follower 248, and a cam follower mounting pin 250 with associated fastening hardware 432 and 434.

The facing pad 240 is attached to a first surface of the plate member 412 for bearing against and engaging a bag 116 or other article to be turned. When no bag 116 is present, the facing pad 240 contacts the table surface 176. The facing pad 240 is preferably constructed of a material having a high coefficient of friction with respect to the material from which bags 116 are constructed, but a low coefficient of friction with respect to the table surface 176. A suitable facing pad material for use in an article rotating machine intended for processing most paper and plastic bags and having a stainless steel table surface 176 is an abrasive cleaning pad stock commercially available from Minnesota Mining and Manufacturing Corporation under the trade name "Scotch-Brite." Although the facing pad material may be somewhat abrasive, the table surface 176 is preferably constructed of a material which is sufficiently durable that the table surface 176 provides acceptable service life in normal use.

The mounting base 270 is attached to the opposite surface of the plate member by fastening hardware 426 for receiving the support shaft 276. The support shaft 276 is preferably securely attached to the mounting base 270. Support bearing means 242 and 424 extend through the cross member 214 for receiving the platen support shaft 276. The support bearing means 242 and 424 preferably allow the support shaft 276 to rotate, and also allows the support shaft 276 to move a limited distance along its longitudinal axis. Any suitable device may be used as support bearing means 242, 424. For example, a commercial roller or sleeve bearing having a splined receptacle, in cooperation with mating splines or keys on the support shaft 276, could be used.

The positions of the conveyer 190 and the dimensions of the components of platen 238 are preferably selected so that when the platen carriage assembly 200 is traveling from the infeed station 112 to the outfeed station 114 (i.e., in the direction of arrow 178), the platen bears against table surface 176 or, if present, bag 116. Permitting the support shaft 276 to move along the longitudinal axis advantageously allows the inventive machine 100 to accommodate bags 116 (or other articles) of various thicknesses, and avoids the need to provide a perfectly flat table surface 176 or to perfectly adjust the position of the conveyer 190 with respect thereto. Resilient means 268, loaded in compression, urges the platen surface away from the carriage 410 and into secure engagement with the bag 116 or table surface 176. Resilient means may 268 may be implemented using any suitable elastic compression medium, such as a conventional spring.

A crank member 246 is rotationally attached to the support shaft 276. The crank member extends horizontally to support a cam follower 248 mounted for rotation on a mounting pin 250 with associated mounting hardware 432 and 434. It will be appreciated that movement of the crank member 246 causes the platen disk 412 to rotate. A resilient means 272 connects a first post 280 affixed to cross piece 214 to a second post 278 attached to the crank member 246. The resilient means is loaded in tension to urge the crank member 246, and therefore the platen disk 412, to a "home" position (see FIG. 2). The crank member may be rotated by an angular displacement 252 to a second position (shown in phantom in FIG. 2), thereby causing the platen disk 412 to rotate by an equivalent angular displacement 236. For many applications, the preferred angular displacements will be 90 degrees. However, it will be appreciated that slight modifications will permit the inventive machine 100 to rotate articles through any desired angular displacement.

A second cam follower 256 is mounted for rotation on a mounting pin 258 which is affixed by associated mounting hardware 420 and 422 to the carriage cross member 214. As best seen in FIGS. 3–6, upper and lower sets of cam operating surfaces are respectively provided on the upper and lower surfaces of the conveyer support 310. The upper set comprises cam surfaces 360 and 362 which extend parallel to each other and to the X-axis along substantially the length of the conveyer support 310. The cam surfaces 360 and 362 form a channel 366. When a particular platen carriage assembly 200 is traveling from the outfeed station 114 to the infeed station 112 (i.e. in the direction of arrow 122), the assembly 200 is located generally above the conveyer support 310, and cam follower 256 extends into the channel 366. The cam follower 256 cooperates with the cam surfaces 360 and 362 to retain the platen carriage assembly 200 in a desired lateral position.

The lower set of cam surfaces comprises first and second cam surfaces 260 and 262 which also extend along substantially the length of the conveyer support 310, forming a channel 418. Cam surface 260 is preferably oriented in parallel to the conveyer support 310. However, as best seen in FIG. 3, cam surface 262 is preferably oriented at a slight oblique angle. As a result, at positions near the infeed station 112, cam surface 262 is located at a relatively large distance from cam surface 260, forming a wide portion 414 (FIG. 3) in channel 418. At positions near the outfeed station 114, the cam surface 262 is located at a relatively small distance from cam surface 260, forming a narrow portion 416 in channel 418.

When a particular platen carriage assembly 200 is traveling from the infeed station 112 to the outfeed station 114 (i.e. in the direction of arrow 178), the assembly 200 is located generally below the conveyer support 310. Cam followers 248 and 256 extend upward toward the conveyer support for engagement with cam surfaces 260 and 262. As the platen carriage assembly 200 travels around sprockets 150 and 148, cam follower 248 and crank 246 are held resiliently in their home position (see FIG. 2) by resilient means 272. As the platen carriage assembly 200 approaches the linear portion of its travel circuit (shown in phantom positions 370, 372, and 374 of FIG. 5), the platen disk 412 gradually settles upon and engages a bag 116. Cam followers 248 and 256 enter the wide portion 414 of channel 418 formed by cam surfaces 260 and 262.

The progress of several platen carriage assemblies 200 as bags 116 are translated and rotated is best seen in FIGS. 1, 3, and 4. Platen carriage assembly **200*b* and bag 116*b* are shown at the beginning of the operation in an initial linear position and corresponding angular orientation. Platen carriage assemblies 200*c* and 200*d*, and bags 116*c* and 116*d*, are shown in mid-operation in intermediate positions and corresponding orientations. Platen carriage assembly 200*e* and bag 116*e* are shown at the end of the operation in the final position and corresponding orientation. Angles 266*b*–266*e* illustrate the respective angular displacement of the platen disk 410** at each position.

As the platen carriage assembly 200 proceeds in the direction of arrow 178, the oblique angular orientation of cam surface 262 causes it to gradually become closer to cam surface 260. As the platen carriage assembly 200 proceeds, cam follower 248 bears against cam surface 262. Cam follower 256 bears against cam surface 260, preventing the force exerted by cam surface 262 on cam follower 248 from laterally displacing the platen carriage assembly 200. The force exerted by cam surface 262 on cam follower 248 gradually rotates crank member 246 in the direction of arrow 252 (FIG. 2), thereby simultaneously rotating platen disk 410, and any bag 116 thereunder, in the direction of arrow 236. The platen carriage assembly 200 continues until it has reached the end of the linear portion of its travel circuit. At this point, the cam followers 248 and 256 have reached the narrow portion 416 of channel 418, and the platen disk 410 and bag 116 have been rotated by the desired angular displacement 236.

As the platen carriage assembly 200 begins to follow the curvature of sprockets 192, 194, the platen disk 410 is gradually elevated, releasing its engagement with the bag 116. As soon as cam follower 248 is released from channel 418, resilient means 272 urges crank member 246 and platen disk 410 to return to the home position. In order to avoid disturbing the orientation of the bag 116, cam followers 248 and 256 preferably remain within channel 418 until the platen disk 410 has completely disengaged bag 116.

The aforementioned combination of front and rear attachment means 220, 222, 224, and 230 advantageously allows the platen carriage assembly 200 to accompany chains 144, 146 in both linear and curved portions of the chain travel circuit. As noted above, the leg members 210 and 212 are substantially linear bar-shaped members. When the platen carriage assembly is located at a linear portion of the chain travel circuit, the chains 144 and 146, and the leg members 210 and 212 conform to the same shape. As a result, the distance between the front attachment means 222, 220 and the rear attachment means 230, 224, as measured along the chain, is identical to that distance measured along the leg members.

As best seen in FIG. 5, when the platen carriage assembly is located at a curved portion of the chain travel circuit, such as the locations where the chain follows the curvature of drive sprockets 148, 150, (or 192, 194), the leg members become an interior chord of the curve. The distance between the front and rear attachment means as measured along the chain—i.e., the distance along the circumference of the sprocket between two points thereon—remains constant because the connecting members are affixed to the chain. However, the distance between the attachment means, as measured along the leg members—i.e., the straight-line distance between two points on the circumference of the sprocket—is reduced.

Thus, the slidable rear attachment means 230 and 224 advantageously permit drive chains 144, 146 to conform to the shape of the drive sprockets, while allowing attachment of the platen carriage 410 to the drive chains at two points on each chain. This feature significantly improves the stability of the platen carriage assemblies. If the platen carriage assemblies were attached to only a single point on each chain, the attachment would be subject to large moment forces, and the position of the platen carriage assemblies would be difficult to control.

An additional advantage of the inventive attachment means, in which the carriage becomes an interior chord of the sprockets, is that it helps avoid interference between the platen disk 412 and the bag 116 or table surface 176 as the platen carriage assembly approaches or recedes from the table surface. FIG. 5 shows platen disks in several positions 370, 372, and 374 as a platen carriage assembly completes its rotation around drive sprocket 148 and approaches the bag 116 and table surface 118. The platen is attached to the carriage cross member 214, which is located at a position between the front and rear carriage-to-chain attachment points.

In linear portions of the platen travel path, the carriage cross member 214 is aligned with chains 144 and 146, and thus the platen spaced from the chain by a first distance. However, when the platen is traveling around the drive sprockets, the place on the carriage cross member 214 at which the platen is connected is located on the interior of the circle formed by the chain. Accordingly, the center of the platen is spaced from the chain by a second distance which is less than the first distance. In effect, the radius of the platen, as it rotates around the drive sprockets, is reduced.

When the platen carriage assembly undergoes the transition from the circular to the linear portions of its travel circuit, such as when it approaches the table surface, the platen face is gradually extended away from the chains. When the platen carriage assembly undergoes the transition from the linear to the circular portions of its travel circuit, the platen face is gradually retracted toward the chains. As a result, when the platen carriage assembly approaches the table surface, the platen face is gradually lowered onto the surface and awaiting bag. (See FIG. 5, positions 370, 372, and 374).

As noted previously, the advantages provided by the combination of exclusively pivotal attachments at one end of the carriage leg members 210, 212 with pivotal and slidable attachments at the opposite end of the leg members, would also be achieved if the order of the attachments were reversed.

In addition, the variation in platen-to-chain spacing provided by the present invention advantageously prevents interference between the platen disk and the bag or table surface. If the platen remained at a constant distance from the drive chains, the edge of the platen disk would encounter the table surface because the disk extends tangentially a substantial distance from its center.

The above-described embodiments of the invention are merely examples of ways in which the invention may be carried out. Other ways may also be possible, and are within the scope of the following claims defining the invention.

What is claimed is:

1. An assembly for rotating and translating flat articles having a major surface and at least one edge, said assembly comprising:

a table extending in a longitudinal direction, said table having first and second ends and a stationary, substantially planar table surface;

means for placing an article on said table surface adjacent to said first end;

a conveyer spaced from said table surface and extending in said longitudinal direction, said conveyer having at least one article transport means for urging said article against said table surface and slidably transporting said article along said table surface from said first end to said second end, whereby said article transport means rotates said article through a predefined angular displacement by engagement with said article independent of any of said edges and simultaneously transports said article along said table from said first end to said second end.

2. A device for rotating and translating flat articles comprising:

a table extending in a longitudinal direction, said table having first and second ends and a stationary, substantially planar table surface;

means for placing an article on said table surface adjacent to said first end;

conveyer means spaced from said table surface and extending in said longitudinal direction, said conveyer means having at least one article transport means and drive means for cyclically moving said article transport means from said first end to said second end and back again;

said article transport means comprising means for engaging said article against said table surface such that said article is slidably transported along said table surface from said first end to said second end synchronously with the movement of said article transport means, and means for rotating said engaging means through a predefined angular displacement simultaneous with the movement of said article transport means from said first end to said second end.

3. The device of claim 2 wherein said table surface has a low coefficient of friction.

4. The device of claim 2 wherein said means for engaging said article has an article contact surface of a material selected to maximize friction between said surface and said article.

5. The device of claim 2 wherein said means for rotating said article engaging means is responsive to the position of said article transport means in said longitudinal direction.

6. The device of claim 2 wherein said predefined angular displacement is approximately 90 degrees.

7. The device of claim 2 wherein said conveyer means has a plurality of article transport means.

8. The device of claim 2 wherein said conveyer means comprises:

first and second support elements respectively disposed adjacent to said first and second ends;

at least one flexible drive means arranged in a continuous looped circuit extending around said first and second support elements and substantially linearly therebetween; and means for rotating at least one of said support elements to cause said drive means to travel along said circuit.

9. The device of claim 8 wherein said flexible drive means is a continuous chain loop and said first and second support elements are sprockets engaging said chain.

10. The device of claim 8 wherein said article transport means comprises a carriage, said carriage having first and second means for attachment to said flexible drive means.

11. The device of claim 10 wherein:

said first attachment means permits substantially exclusively pivotal movement of said carriage with respect to said flexible drive means; and said second attachment means permits both pivotal and slidable movement of said carriage with respect to said flexible drive means.

12. The device of claim 10 wherein:

said first attachment means comprises a small circular first aperture in said carriage and a pin attached to said flexible drive means and extending through said aperture; and said second attachment means comprises a longitudinal slot aperture in said carriage and a pin attached to said flexible drive means and extending through said aperture.

13. The device of claim 8 wherein:

said first and second support means have a substantially circular periphery;

said flexible drive means conforms to the circular periphery of said first and second support means in at least portions of its travel circuit; and said article transport means comprises a carriage, said carriage having first and second means for attachment to said flexible drive means;

said first and second attachment means being so arranged that a line extending through said first and second attachment means forms an interior chord of said circular periphery as said carriage travels around said first and second support means.

14. The device of claim 2 wherein:

said conveyer includes a structural element extending in said longitudinal direction substantially from said first end to said second end, said structural element having at least one cam surface extending along said structural element in a direction oblique to said longitudinal direction, and wherein said means for rotating said article engaging means through a predefined angular displacement comprises a cam follower attached to said article engaging means for operating against said cam surface and rotating said article engaging means responsive thereto.

15. The device of claim 2 further comprising means for providing a pressurized stream of gas adjacent said table surface whereby friction between said article and said table surface is reduced.

16. A device for rotating flat articles and translating said articles from a first end of said device to a second end of said device, said first end and said second end being spaced from one another along a longitudinal direction, comprising:

means adjacent to said first end for receiving an article;

conveyer means extending in said longitudinal direction, said conveyer means having at least one article transport means and drive means for cyclically moving said article transport means from said first end to said second end and back again;

said conveyer means comprising first and second support elements respectively disposed adjacent to said first and second ends, at least one flexible drive means arranged in a continuous looped circuit extending around said first and second support elements and substantially linearly therebetween, and means for rotating at least one of said support elements to cause said drive means to travel along said circuit;

said article transport means comprising a carriage, and means attached thereto for engaging and rotating said article, said carriage having first and second means for attachment to said flexible drive means, said first attachment means permitting substantially exclusively pivotal movement of said carriage with respect to said flexible drive means, and said second attachment means permitting both pivotal and slidable movement of said carriage with respect to said flexible drive means.

17. The device of claim 16 wherein:

said first attachment means comprises a pin attached to said flexible drive means and extending through an aperture in said carriage; and said second attachment means comprises a a pin attached to said flexible drive means and extending through a longitudinal slot in said carriage.

18. The device of claim 16 further comprising a substantially planar table surface spaced from said conveyer means and extending in said longitudinal direction; and wherein said means for engaging and rotating said article also urges said article against said table surface such that said article is slidably transported along said table surface from said first end to said second end synchronously with the movement of said article transport means.

19. The device of claim 18 wherein said means for engaging and rotating said article can rotate said article through a predefined angular displacement simultaneous with the movement of said article transport means from said first end to said second end.

* * * * *